US005950460A

United States Patent [19]

Oh

[11] Patent Number: 5,950,460

[45] Date of Patent: Sep. 14, 1999

[54] WASHING MACHINE WITH AGITATOR

[75] Inventor: Ock-Hwan Oh, Kwangju, Rep. of Korea

[73] Assignee: Daewoo Electronics Co., Ltd., Seoul, Rep. of Korea

[21] Appl. No.: 09/049,994

[22] Filed: Mar. 30, 1998

[30] Foreign Application Priority Data

May 28, 1997 [KR] Rep. of Korea ..... 97-21141

[51] Int. Cl.[6] ..... D06F 17/08; D06F 17/10

[52] U.S. Cl. ..... 68/134; 68/131

[58] Field of Search ..... 68/133, 134, 131

[56] References Cited

U.S. PATENT DOCUMENTS

| | | | |
|---|---|---|---|
| 2,076,280 | 4/1937 | Schroeder | 68/131 |
| 5,791,167 | 8/1998 | Wyatt et al. | 68/131 X |
| 5,850,750 | 12/1998 | Cho | 68/134 X |

FOREIGN PATENT DOCUMENTS

| | | | |
|---|---|---|---|
| 1125004 | 7/1956 | France | 68/133 |
| 1131586 | 10/1956 | France | 68/133 |
| 1010046 | 6/1957 | Germany | 68/133 |
| 1018384 | 10/1957 | Germany | 68/133 |
| 304010 | 3/1955 | Switzerland | 68/131 |
| 167806 | 11/1965 | U.S.S.R. | 68/131 |

*Primary Examiner*—Philip R. Coe

*Attorney, Agent, or Firm*—Smith, Gambrell & Russell; Beveridge, DeGrandi, Weilacher & Young Intellectual Property Group

[57] ABSTRACT

A washing machine with agitator is disclosed. The washing machine with agitator has a washing tub of which a bottom surface protrudes axially and inwardly like a pyramid, wherein the washing tub has at least two slanted portions which slant upwardly from an edge of the bottom surface toward an inside central axis of the washing tub. A washing shaft is rotatably installed and extended vertically from a lower space in the washing machine to the bottom surface of the washing tub. A driving wheel is installed on the washing shaft, wherein a frictional surface is formed on one side of the driving wheel. At least two frictional wheels rotate and contact with the frictional surface of the driving wheel. At least two driven wheels of which a frictional surface formed on one side contacts with the frictional wheels respectively, wherein the driven wheels are rotatably installed on one surface of the slanted portions. At least two stirring blades are installed on the other surface of the slanted portions to connect with the driven wheels, thereby the stirring blades generate a rotating water flow in the washing tub. Therefore, respective rotating water flows are generated which prevent laundry gathering in the center of the washing tub from tangling. Accordingly the washing time is shortened, and the washing effect is enhanced.

13 Claims, 3 Drawing Sheets

WASHING MACHINE WITH AGITATOR

BACKGROUND OF THE INVENTION

1. Field of the Invention

The present invention relates to a washing machine with an agitator, and more particularly to a washing machine with an agitator for rotating washing water accommodated in a washing tub to wash laundry.

2. Description of the Prior Art

Generally, washing operation of a washing machine consists of a plurality of processes, that is, a water supplying process for supplying washing water into a washing tub, a washing process for washing laundry with the washing water supplied through the water supplying process, a rinsing process for rinsing laundry washed through the washing process, and a dehydrating process for dehydrating laundry rinsed through the rinsing process.

A general washing machine which performs the above washing operation has, as shown in FIG. 1, an outer tub 110 installed in a casing 100, a washing tub 120 installed in the outer tub 110 for accommodating laundry and water, a pulsator 130 mounted on the bottom surface of the washing tub 120 for rotating the washing water in the washing tub 120, a driving motor 140 disposed under the outer tub 110 for driving the pulsator 130, and a gear assembly 150 for transmitting the power of the driving motor 140 selectively to the pulsator 130 and the washing tub 120.

The outer tub 110 has a cylindrical shape which allows a rotating water flow generated during washing operation and is suspended in the casing 100 by a suspending bar 180. One end of the suspending bar 180 is connected to a damper 160 attached on a low portion of surface of the outer tub 110, and the other end of it 180 is fixed on the upper portion of inner wall of the casing 100. Also, the washing tub 120 having a cylindrical shape is installed in the outer tub 110 rotatively. A plurality of holes 170 are formed on the wall of the washing tub 120 such that the washing water supplied into the washing tub 120 flows to the side of the outer tub 110 through the holes 170. Accordingly, levels of water in the washing tub 120 and the outer tub 110 are equal. Also, the dirty washing water and any sediments which are generated from the washing water during the dehydrating process are deposited to the outer tub 110 through the holes 170. And, the pulsator 130 installed on the bottom surface of the washing tub 120 rotates clockwise and counterclockwise by the driving motor 140 and the gear assembly 150.

In the washing process, the power of the driving motor 140 is transmitted to the pulsator 130 via the gear assembly 150, thereby the pulsator 130 rotates such that a water flow rotating in the washing tub 120 is formed. The washing process of laundry accommodated in the washing tub 120 by the rotating water flow generated by the pulsator 130 is performed. In the dehydrating process, the power of the driving motor 140 is transmitted to the washing tub 120 and the pulsator 130 via the gear assembly 150 such that the washing tub 120 and the pulsator 130 rotate integrally at high speed. At this time, by the centrifugal force generated by the rotation of the pulsator 130, the dehydrating process is performed. Also, when the pulsator 130 rotates clockwise and counterclockwise, the outer tub 110 strongly vibrates due to the rotation of the washing tub 120 and the washing water. The vibration is alleviated by the damper 160 attached on the outer surface of the outer tub 110.

As described above, in the conventional washing machine, as indicated by the direction of the arrow in FIG. 1, the laundry moves to the central portion of the washing tub 120 to be twisted by the rotating water flow generated when the pulsator 130 rotates clockwise and counterclockwise. Therefore, efficiency of the washing machine is reduced. That is, when the rotating water flow is generated in the washing tub 120, the laundry rotates to be scrubbed by the rotating water flow, thereby the washing process is performed. At this time, the laundry moves to the central portion of the washing tub 120 to be twisted by the rotating water flow. Since the laundry once twisted is not likely to be scrubbed even by the rotating water flow, too much washing time is wasted and the efficiency of washing declines.

Also, since the pulsator 130 rotates in the lower portion of the washing tub 120, the strong water flow is generated in the lower portion of the washing tub 120 so the water flow as a result becomes weak at the upper portion of the washing tub 120. Accordingly, when the amount of the water accommodated in the water tub 120 is great, the laundry is efficiently washed in the lower portion of the washing tub 120, but contrarily the laundry is not efficiently washed in the upper portion of the washing tub 120. Moreover, according to the tendency for larger sized washing machines, the washing tub 120 with large capacity is adopted, so the laundry is not efficiently washed by the pulsator 130 installed in the bottom surface of the washing tub 120.

SUMMARY OF THE INVENTION

Therefore, the present invention has been proposed to overcome the above described problems in the prior art, and accordingly it is an object of the present invention to provide a washing machine with an agitator which generates a rotating water flow that prevents laundry from gathering and tangling in the center of the washing tub so that the washing time is shortened and the washing effect is enhanced respectively. To achieve the above objects, the present invention provides a washing machine with an agitator comprising, a washing tub of which a bottom surface protrudes axially and inwardly, wherein the bottom surface having at least two slanted portions which slant upwardly from an edge of the bottom wall toward an inside central axis of the washing tub, a washing shaft rotatably installed and extended vertically from a lower space in the washing machine to the bottom surface of the washing tub, a driving wheel installed on the washing shaft, wherein a frictional surface is formed on one side of the driving wheel, at least two frictional wheels rotating and contacting with a frictional surface of the driving wheel, at least two driven wheels of which a frictional surface formed on one side contacts with the frictional wheels respectively, wherein the driven wheels are rotatably installed on one surface of the slanted portions, and at least two stirring blades which are installed on the other surface of the slanted portions to connect with the driven wheels, wherein the stirring blades generate rotating water flow in the washing tub.

Furthermore, the bottom surface of the washing tub can have a pyramid shape. The driving wheels can have a truncated cone shape, and also, the frictional surfaces of the driving wheels can be curved concavely. The frictional surfaces of the driving wheel can be formed on the upper portion of the driving wheel. The rotating axis of the frictional wheel and the rotating axis of the driving wheel cross perpendicularly, so the power of the driving wheel can be transmitted to the frictional wheel efficiently. The slanted portions, the frictional wheels, the stirring blades, and the driven wheels can number four respectively. And, the agitator of washing machine can further comprise a washing bar extending upwardly from an upper end of the washing shaft to the inside of the washing tub and having a plurality of swing blades formed on a periphery of the washing bar.

Also, a washing machine with an agitator in the present invention comprises a washing tub of which a bottom surface protrudes axially and inwardly, wherein the bottom surface having four slanted portions which slant upwardly from an edge of the bottom surface toward the inside central axis of the washing tub, a washing shaft rotatably installed and extended vertically from a lower space in the washing machine to the bottom surface of the washing tub, a driving wheel installed on the washing shaft, wherein a frictional surface is formed on one side of the driving wheel, four frictional wheels rotating and contacting with a frictional surface of the driving wheel, four driven wheels of which a frictional surface formed on one side contacts with the frictional wheels respectively, wherein the driven wheels are rotatably installed on one surface of the slanted portions, four stirring blades which are installed on the other surface of the slanted portions to connect with the driven wheels, wherein the stirring blades generate a rotating water flow in the washing tub, and a washing bar extending upwardly from an upper end of the washing shaft to the inside of the washing tub and having a plurality of swing blades formed on a periphery of the washing bar.

Preferably, the bottom surface of the washing tub has a pyramid shape. Furthermore, the frictional surfaces of the driving wheel can be curved concavely. Also, the frictional surface of the driving wheel can be formed on the upper portion of the driving wheel. Preferably the rotating axis of the frictional wheel and the rotating axis of the driving wheel cross perpendicularly, so the power of the driving wheel can be transmitted to the frictional wheel efficiently.

Therefore, a respective rotating water flow is generated which prevents laundry from gathering in the center of the washing tub and tangling, accordingly the washing time is shortened and the washing effect is enhanced.

BRIEF DESCRIPTION OF THE DRAWINGS

The above objects and other advantages of the present invention will become more apparent by describing in detail preferred embodiment thereof with reference to the attached drawings in which.

DETAILED DESCRIPTION OF THE PREFERRED EMBODIMENTS

Embodiments of the present invention will now be described below with reference to the figures.

Figure 1:
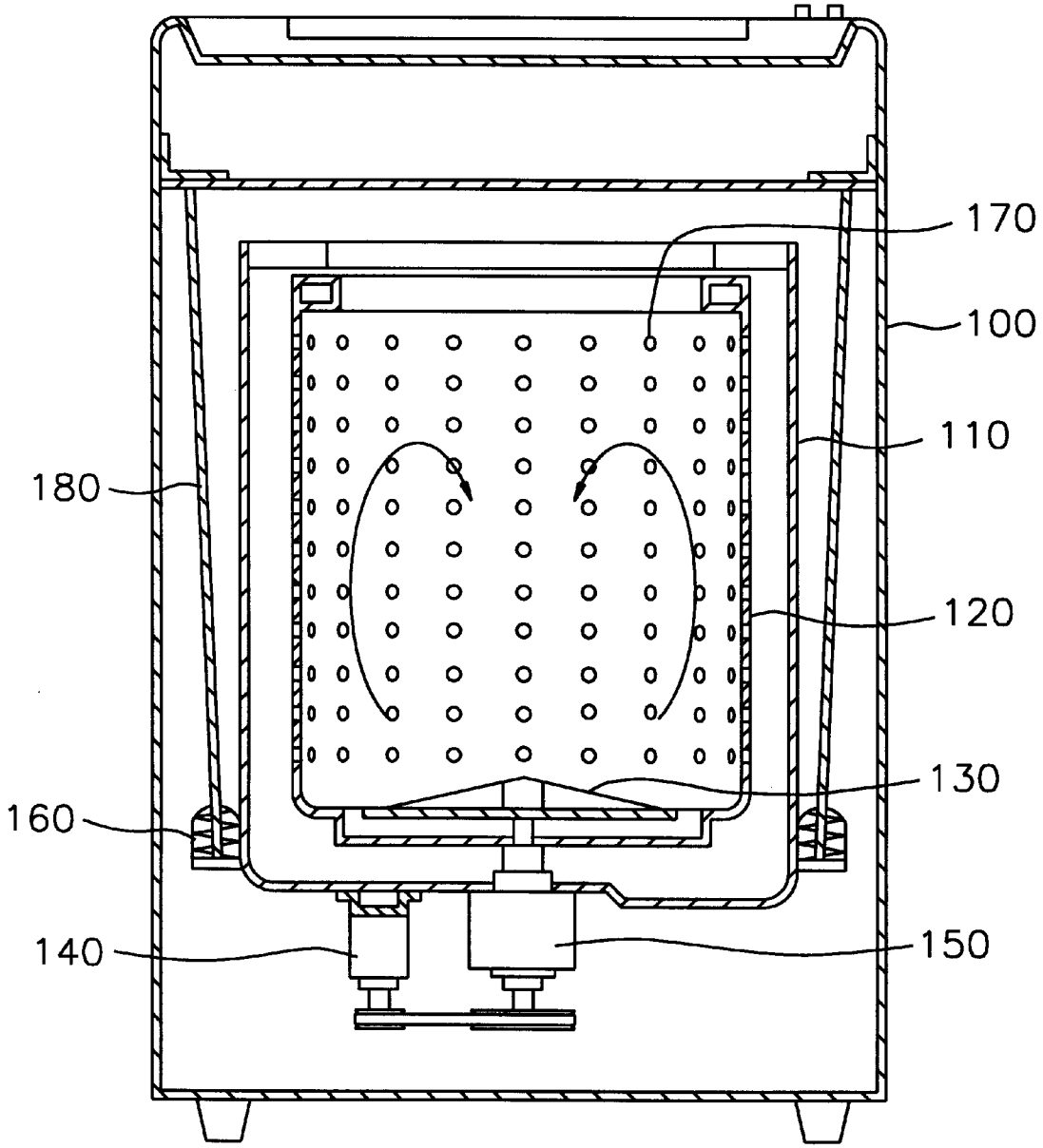
FIG. 1 PRIOR ART
FIG. 1 is a side sectional view of a conventional washing machine.
Figure 2:
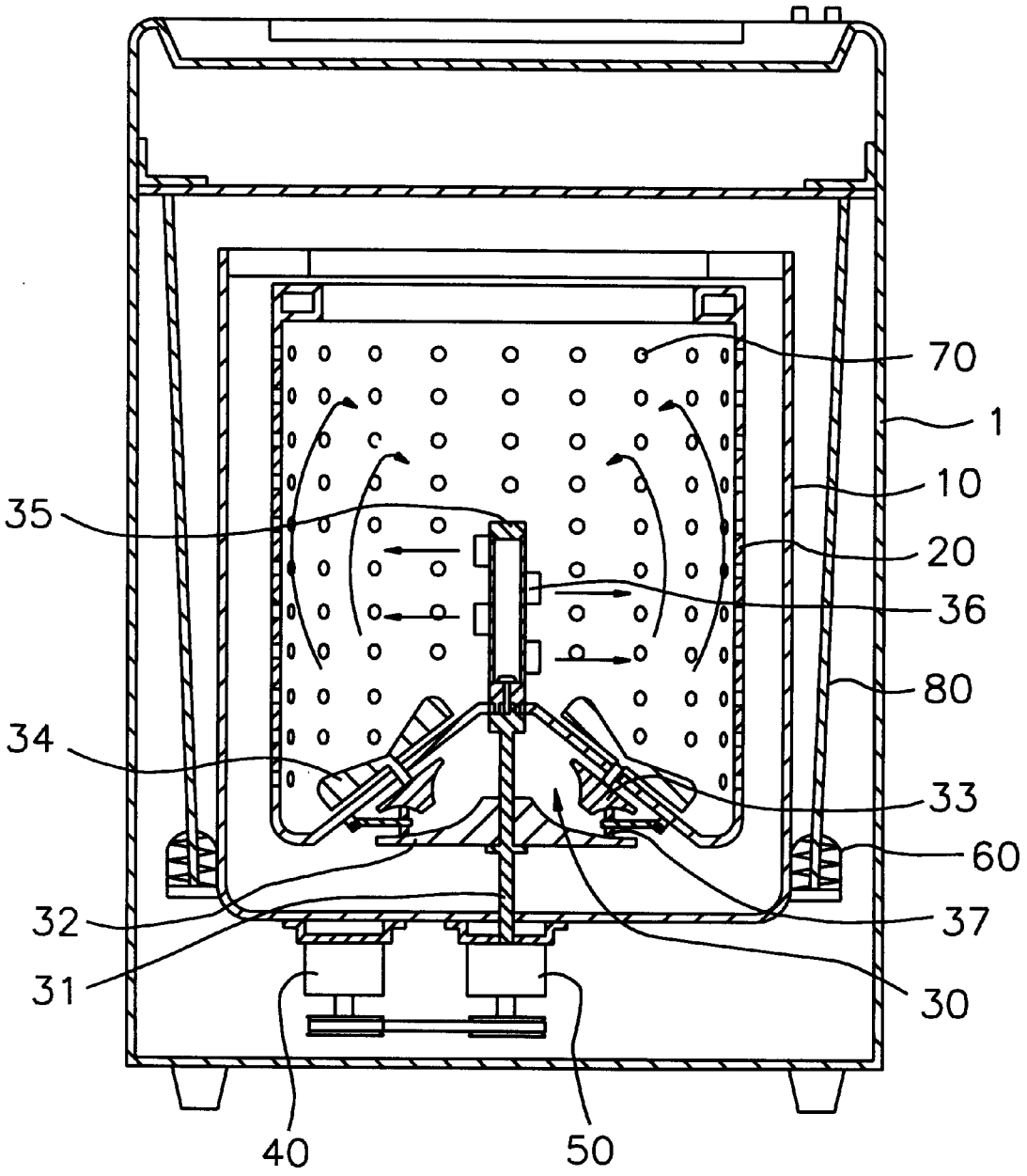
FIG. 2 is a side sectional view of a washing machine having an agitator according to the present invention.
Figure 3:
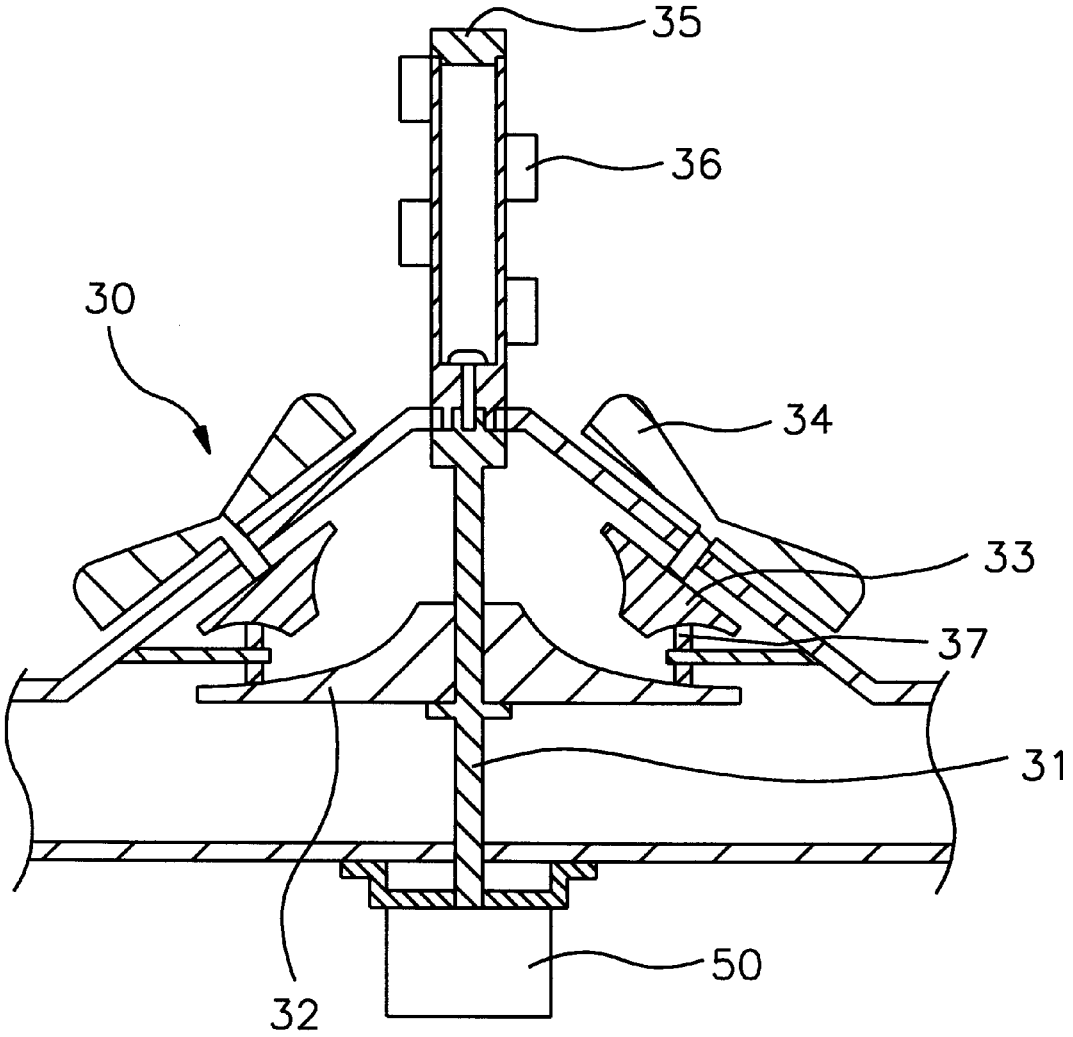
FIG. 3 is an enlarged view of an agitator of the washing machine in FIG. 2.

FIG. 2 is a side sectional view of washing machine having an agitator according to the present invention, and FIG. 3 is an enlarged view of an agitator of washing machine in FIG. 2. As shown in these drawings, a washing machine having an agitator according to the present invention also has, like the conventional washing machine, an outer tub 10 installed in a casing 1, a washing tub 20 installed in the outer tub 10 for accommodating laundry and water, an agitator 30 which is installed on the bottom surface of the washing tub 20 to swing the laundry and the washing water accommodated in the washing tub 20, a driving motor 40 disposed under the outer tub 110 for driving the agitator 30, and a gear assembly 50 for transmitting the power of the driving motor 40 selectively to the agitator 30 and the washing tub 20.

The outer tub 10 is suspended in the casing 1 by a suspending bar 80. The suspending bar 80 is connected to a damper 60 attached on a lower portion of a surface of the outer tub 10. The washing tub 20 is installed in the outer tub 10 rotatively. A plurality of holes 70 are formed on the wall of the washing tub 20. The agitator 30 installed on the bottom surface of the washing tub 20 rotates clockwise and counterclockwise by the driving motor 40 and the gear assembly 50.

The agitator 30 is composed of a washing shaft 31 being connected with the gear assembly 50 mounted in a lower space in the washing machine to transmit the power and extending upwardly to the bottom surface of the washing tub 20 from the gear assembly 50, a driving wheel 32 installed on the washing shaft 31, four driven wheels 33 being driven by the driving wheel 32 to rotate, and four stirring blades which are installed on the bottom surface of the washing tub 20 and are driven by each driven wheel 33 to rotate for generating a plurality of rotating water flows to agitate the laundry in the washing tub 20, etc.

The bottom surface of the washing tub 20 protrudes axially and inwardly to have a pyramid shape. That is, four slanted portions that slant upwardly at 45 angle from an edge of the bottom surface toward an inside central axis of the washing tub 20 are formed on the bottom surface of the washing tub 20. A washing bar 35 extends upwardly from an upper end of the washing shaft 31 to the inside of the washing tub 20, and a plurality of swing blades are formed on a periphery of the washing bar 35.

The driving wheel 32 has a truncated cone shape, and the frictional surface which is curved concavely is formed on the upper portion of the driving wheel 32. Four frictional wheels 37 rotatably contact with the frictional surface of the driving wheel 32. Each driven wheel 33 is rotatably installed on one surface of the slanted portions such that it 33 contacts with the frictional surface which is formed on one side of each frictional wheel 37. Therefore, the driving wheel 32 rotates together with the driven wheels 33 through the intermediary of the frictional wheels 37.

That is, the rotating axis of each frictional wheel 37 and the rotating axis of each driving wheel 32 cross perpendicularly, and the surface of the frictional wheel 37 touches frictionally with the frictional surface formed on the upper portion of the driving wheel 32. Also, the frictional wheel 37 touches frictionally with the driven wheels 33 installed on the other surface of the washing tub 20.

Accordingly, four stirring blades 34 which are installed on four slanted portions rotate integrally with the driven wheels 33, and the rotating water flow is generated upwardly at 45 angle from the bottom surface.

Hereinbelow, the operation and the effect of the washing machine with the agitator in accordance with the present invention will be described.

In the washing process, the power of the driving motor 40 is transmitted to the washing shaft 31 of the agitator 30 through the gear assembly 50, thereby the washing shaft 31 rotates integrally with the driving wheel 32. The driving wheel 32 rotates having the washing shaft 31 extended in a vertical direction as the center axis. The driven wheels 33 rotate such that the stirring blades 34 in the washing tub 20 rotate. Therefore, as designated by the directions of the arrows in FIG. 2, a plurality of rotating water flows are generated in the washing tub 20. Accordingly, these rotating water flows collide with each another resulting in the turbulent flows. The turbulent flows prevent the laundry from tangling.

At this time, the washing bar 35 rotates together with the stirring blades 34 by rotation of the washing shaft 31 such that a plurality of swing blades of the washing bar 35 strike the laundry. Accordingly, the washing effect is even more enhanced.

In the dehydrating process, the power of the driving motor 40 is transmitted to the washing tub 20 and the washing bar 35 via the gear assembly 50 such that the washing tub 20 and the washing bar 35 rotate integrally at high speed. At this time, the stirring blades 34 do not rotate. Also, in the washing process when the washing bar 35 and the stirring blades 34 rotate clockwise and counterclockwise, the outer tub 10 strongly vibrates. The vibration is reduced by the damper 60 attached on the outer surface of the outer tub 10.

As described above, by the agitator of washing machine according to the present invention, respective rotating water flows are generated to prevent the laundry from gathering in the center of the washing tub. Accordingly, the washing time is shortened, and the washing effect is enhanced.

In the above, the present invention is described in detail by using the preferred embodiment, but the invention is not limited to the above embodiment. It should be obvious to people skilled in the conventional art that modifications can be made to the invention as described above without departing from the spirit or the scope of the invention. However the invention is limited by the accompanying claims as below.

What is claimed is:

1. A washing machine with agitator comprising:

a washing tub of which a bottom surface protrudes axially and inwardly, wherein the bottom surface has at least two slanted portions which slant upwardly from an edge of the bottom surface toward an inside central axis of the washing tub;

a washing shaft rotatably installed and extended vertically from a lower space in the washing machine to the bottom surface of the washing tub;

a driving wheel installed on the washing shaft, wherein a frictional surface is formed on one side of the driving wheel;

at least two frictional wheels rotating and contacting with the frictional surface of the driving wheel;

at least two driven wheels of which the frictional surface formed on one side contacts with the frictional wheels respectively, wherein the driven wheels are rotatably installed on one surface of the slanted portions; and at least two stirring blades which are installed on the other surface of the slanted portions to connect with the driven wheels, wherein the stirring blades generate a rotating water flow in the washing tub.

2. The washing machine with agitator as claimed in claim 1, wherein the bottom surface of the washing tub has a pyramid shape.

3. The washing machine with agitator as claimed in claim 1, wherein the driving wheel has a truncated cone shape.

4. The washing machine with agitator as claimed in claim 3, wherein the frictional surface of the driving wheel is curved concavely.

5. The washing machine with agitator as claimed in claim 4, wherein the frictional surface of the driving wheel is formed on the upper portion of the driving wheel.

6. The washing machine with agitator as claimed in claim 1, wherein the rotating axis of the frictional wheel and the rotating axis of the driving wheel cross perpendicularly.

7. The washing machine with agitator as claimed in claim 1, wherein the slanted portions, the frictional wheels, the stirring blades, and the driven wheels number four respectively.

8. The washing machine with agitator as claimed in claim 1, further comprising a washing bar extending upwardly from an upper end of the washing shaft to the inside of the washing tub and having a plurality of swing blades formed on a periphery of the washing bar.

9. A washing machine with agitator comprising:

a washing tub of which a bottom surface protrudes axially and inwardly, wherein the bottom surface has four slanted portions which slant upwardly from an edge of the bottom surface toward an inside central axis of the washing tub;

a washing shaft rotatably installed and extended vertically from a lower space in the washing machine to the bottom surface of the washing tub;

a driving wheel installed on the washing shaft, wherein a frictional surface is formed on one side of the driving wheel;

four frictional wheels rotating and contacting with a frictional surface of the driving wheel;

four driven wheels of which a frictional surface formed on one side contacts with the frictional wheels respectively, wherein the driven wheels are rotatably installed on one surface of the slanted portions;

four stirring blades which are installed on the other surface of the slanted portions to connect with the driven wheels, wherein the stirring blades generate a rotating water flow in the washing tub; and a washing bar extending upwardly from an upper end of the washing shaft to the inside of the washing tub and having a plurality of swing blades formed on a periphery of the washing bar.

10. The washing machine with agitator as claimed in claim 9, wherein the bottom surface of the washing tub has a pyramid shape.

11. The washing machine with agitator as claimed in claim 9, wherein the frictional surface of the driving wheel is curved concavely.

12. The washing machine with agitator as claimed in claim 11, wherein the frictional surface of the driving wheel is formed on the upper portion of the driving wheels.

13. The washing machine with agitator as claimed in claim 9, wherein the rotating axis of the frictional wheel and the rotating axis of the driving wheel cross perpendicularly.

* * * * *